US005087052A

United States Patent [19]

Simon

[11] Patent Number: 5,087,052

[45] Date of Patent: Feb. 11, 1992

[54] GAME WITH VARIABLY CONFIGURED BOARD

[76] Inventor: Richard M. Simon, 250 Yard Dr., Locust Valley, N.Y. 11560

[21] Appl. No.: 589,983

[22] Filed: Sep. 28, 1990

[51] Int. Cl.[5] ..... A63F 3/00

[52] U.S. Cl. ..... 273/284; 273/272

[58] Field of Search ..... 273/272, 281, 284, 155; 434/172, 173, 175

[56] References Cited

U.S. PATENT DOCUMENTS

| | | | |
|---|---|---|---|
| 2,191,991 | 2/1940 | Lloyd | 273/284 |
| 2,230,178 | 1/1941 | Campbell . | |
| 2,352,555 | 6/1944 | Mandl | 273/155 |
| 2,752,158 | 6/1956 | Brunot et al. . | |
| 3,016,243 | 1/1962 | Irwin | 434/172 X |
| 3,152,806 | 10/1964 | Jackman | 434/172 X |
| 3,163,425 | 12/1964 | Caplan | 273/284 |
| 3,520,072 | 7/1970 | Greenwood . | |
| 3,601,403 | 8/1971 | Weisbecker | 273/155 |
| 3,709,497 | 1/1973 | Barlow . | |
| 3,860,242 | 1/1975 | Martin | 273/284 X |
| 3,947,036 | 3/1976 | Kupec . | |
| 4,043,599 | 8/1977 | Eigen | 273/272 X |
| 4,188,034 | 2/1980 | Dempsey | 273/284 X |
| 4,227,697 | 10/1980 | Castanis . | |
| 4,232,864 | 11/1980 | Yaworsky | 273/284 X |
| 4,236,719 | 12/1980 | Kerr . | |
| 4,244,580 | 1/1981 | Hoyles | 273/272 |
| 4,850,595 | 7/1989 | Sherman et al. . | |

FOREIGN PATENT DOCUMENTS

| | | | |
|---|---|---|---|
| 2489163 | 3/1982 | France | 273/272 |
| 1128269 | 9/1968 | United Kingdom | 273/272 |

*Primary Examiner*—Edward M. Coven
*Assistant Examiner*—William E. Stoll
*Attorney, Agent, or Firm*—Amster, Rothstein & Ebenstein

[57] ABSTRACT

A game played on a game board having an operative configuration of normal squares and special squares, includes a frame and a see-through grid disposed in the frame for releasably receiving game pieces placed thereon and restraining the game pieces against unintended horizontal or vertical displacement. At least one upper planar slide is disposed in a plane below the grid and has normal squares, special squares and see-through squares. At least one lower planar slide is oriented transverse to the upper slide and disposed in a plane below the upper slide, the lower slide having normal squares and special squares (adapted to be viewed through the see-through squares of the upper slide). Optionally, the lower slide also has see-through squares to enable viewing of portions of a conventional game board therebelow (itself having normal and special squares) which can be viewed through the see-through squares of the upper and lower slides when such see-through squares are aligned. The slides together define at least a portion of the game board, each of the slides being mounted in the frame for independent movement in a given plane relative to the other of the slides and to the grid so that the operative configuration of the normal squares and the special squares on the game board may be varied.

23 Claims, 11 Drawing Sheets

GAME WITH VARIABLY CONFIGURED BOARD

BACKGROUND OF THE INVENTION

The present invention relates to a game played on a game board having an operative configuration of normal squares and special squares and, more particularly, to such a game wherein the operative configuration may be varied.

Variety adds interest. That is why games like Scrabble provide not only a matrix of ordinary or normal squares on which the game is played, but also certain special or bonus squares for doubling or even tripling of a particular letter or word occupying the special bonus squares. However, even with the added factor of special bonus squares, playing the same game on the same board can lead to a loss of interest.

For this reason the games disclosed in U.S. Pat. Nos. 3,520,072; 4,236,719; and 4,850,595 permit the board-like members to be replaced by different board-like members in order to vary the configuration of the game and thereby maintain interest in the game. An obvious disadvantage of this approach is that the players must be provided with a supply of different board-like members, one for each new configuration to be played. U.S. Pat. No. 2,230,178 discloses a Bingo-type game which permits the card configuration being played to be switched between two different operative configurations simply by varying the position of the Bingo card with a windowed frame which blocks one set of numbers while allowing the set of numbers to show through the windows. However the number of card configurations possible without actually changing Bingo cards is sharply limited, only two being shown. Thus the need remains for a game which can be played on a board having a large plurality of operative configurations of normal squares and special squares, without the need to provide a supply of different boards.

Accordingly, it is an object of the present invention to provide a game affording a variety of operative configurations of normal squares and special squares without the need for a supply of separate game boards.

Another object is to provide such a game which allows the game board to assume as one of its operative configurations the conventional configuration of normal and special squares.

Yet another object is to provide such a game which can accommodate a variety of interchangeable conventional game boards and thereby enable a variety of different types of games or variations of the same game to be played thereon.

A further object is to provide such a game which is of rugged and economical construction.

SUMMARY OF THE INVENTION

It has now been found that the above and related objects of the present invention are obtained in a game played on a game board having an operative configuration adapted to be changed by the players of the game and which preferably has normal squares and special squares. The game includes a frame, a grid and one or a plurality of slides. The see-through grid is disposed in the frame for releasably receiving game pieces placed thereon and restraining the game pieces against unintended horizontal and vertical displacement. The slide or slides together define at least a portion of the game board, each of the slides being mounted in the frame for independent movement in a given plane relative to the other of the slides and to the see-through grid so that the operative configuration of the game board may be varied.

In a preferred form of the game, the slides include at least one upper planar slide disposed in the frame in a plane below the grid and having a plurality of squares, which are preferably normal squares, special squares and see-through squares, and at least one lower planar slide oriented transverse to the upper slide and disposed in the frame in a plane below the upper slide, the lower slide also having a plurality of squares which are preferably normal squares and special squares. Portions of the lower slides are preferably adapted to be viewed through the see-through squares of the upper slide, and the lower slides may optionally have see-through squares as well.

In a first preferred embodiment, a conventional planar game board is disposed in the frame below the lower slide. Preferably at least some of the lower slides additionally include see-through squares enabling viewing of the vertically aligned squares of the conventional game board below vertically aligned see-through squares of the upper and lower slides.

In a second preferred embodiment, the grid is unnecessary and the conventional game board is transparent or translucent and disposed in the frame above the upper slide. However, if desired, a grid may be disposed in the frame in a plane above the conventional game board for releasably receiving game pieces placed thereon and restraining the game pieces against unintended horizontal displacement.

In either of the preferred embodiments optimally the game additionally includes means for independently releasably fixing each of the slides in a given disposition relative to the frame. The conventional game board defines a matrix of squares, and one of the slides extends longitudinally across the matrix of squares while the other of the slides extends transversely across the matrix of squares. Ordinarily, the totality of the upper slides extends over all of the matrix of squares, and the totality of the lower slides also extends over all of the matrix of squares. Where there are a plurality of the upper slides and a plurality of the lower slides, each of the upper slides and each of the lower slides is mounted in the frame for independent movement relative to the remainder of the upper slides and the remainder of the lower slides, respectively.

The game may additionally include means for directing a change in slide orientation, e.g., one or more decks of cards, each card indicating one of a plurality of changes in slide orientation, which may take place before the game begins or at selected times during play of the game. The game board may be moved between at least two orientations relative to the frame in the same plane but shifted 90°. Preferably, the slides in a particular orientation together effectively define an operative game board having the conventional game board configuration of normal squares and special squares.

The conventional game board may define either a matrix of only normal squares or a matrix of both normal squares and special squares.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1A:
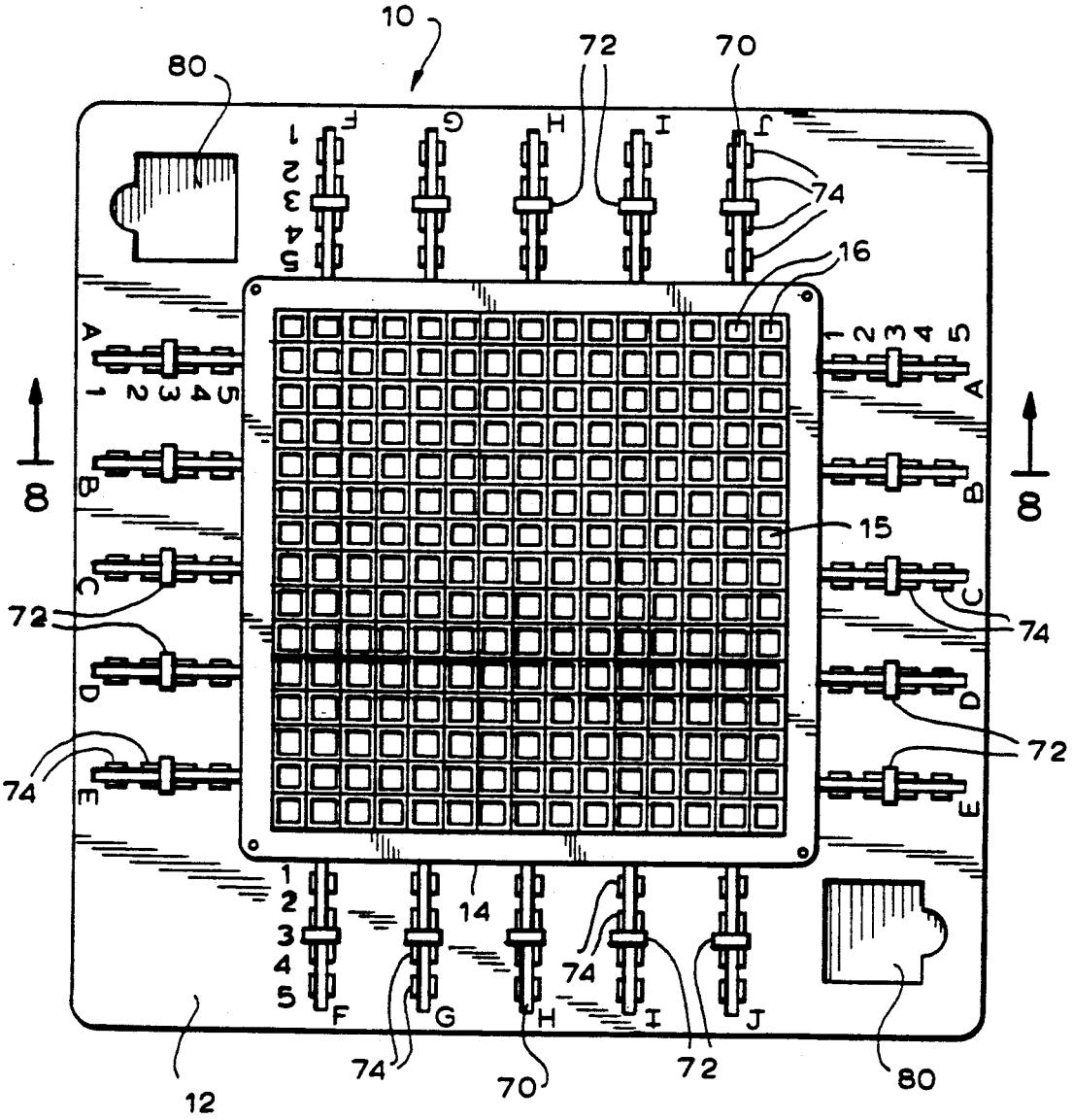
FIG. 1A is a top plan view of a game according to the present invention.
Figure 1B:
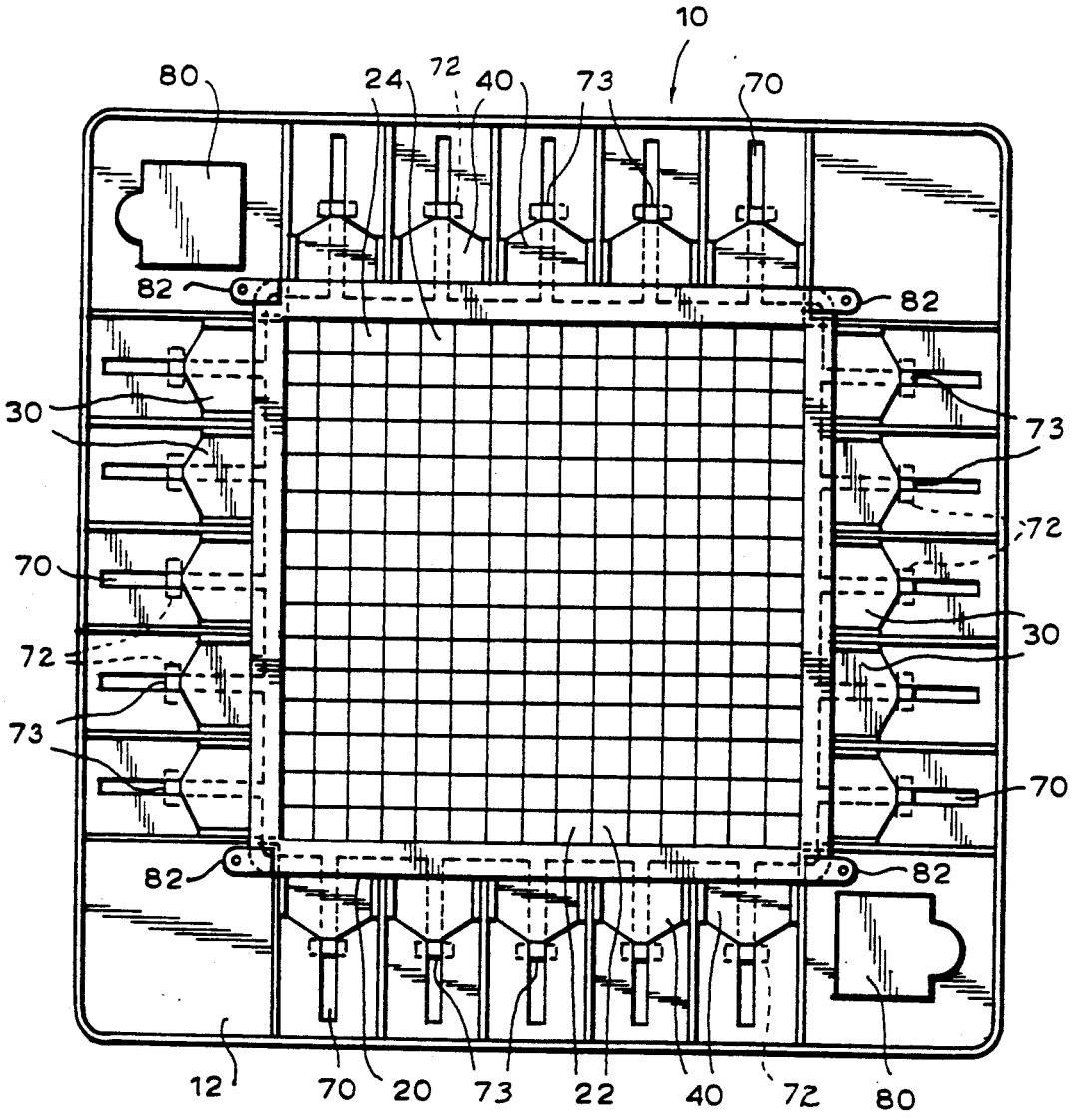
FIG. 1B is a bottom plan view thereof, with portions thereof broken away to reveal details of internal construction.

Referring now to the drawing, and in particular to FIGS. 1A and 1B thereof, therein illustrated is a game, generally designated by the reference numeral 10, according to the present invention. The game 10 includes a frame 12 and a grid 14 disposed in the frame 12 for releasably receiving game pieces 16 placed therein and restraining the game pieces 16 against unintended horizontal and vertical displacement. A conventional planar game board 20 is disposed in the frame 12 below the grid 14.

Figure 2A:
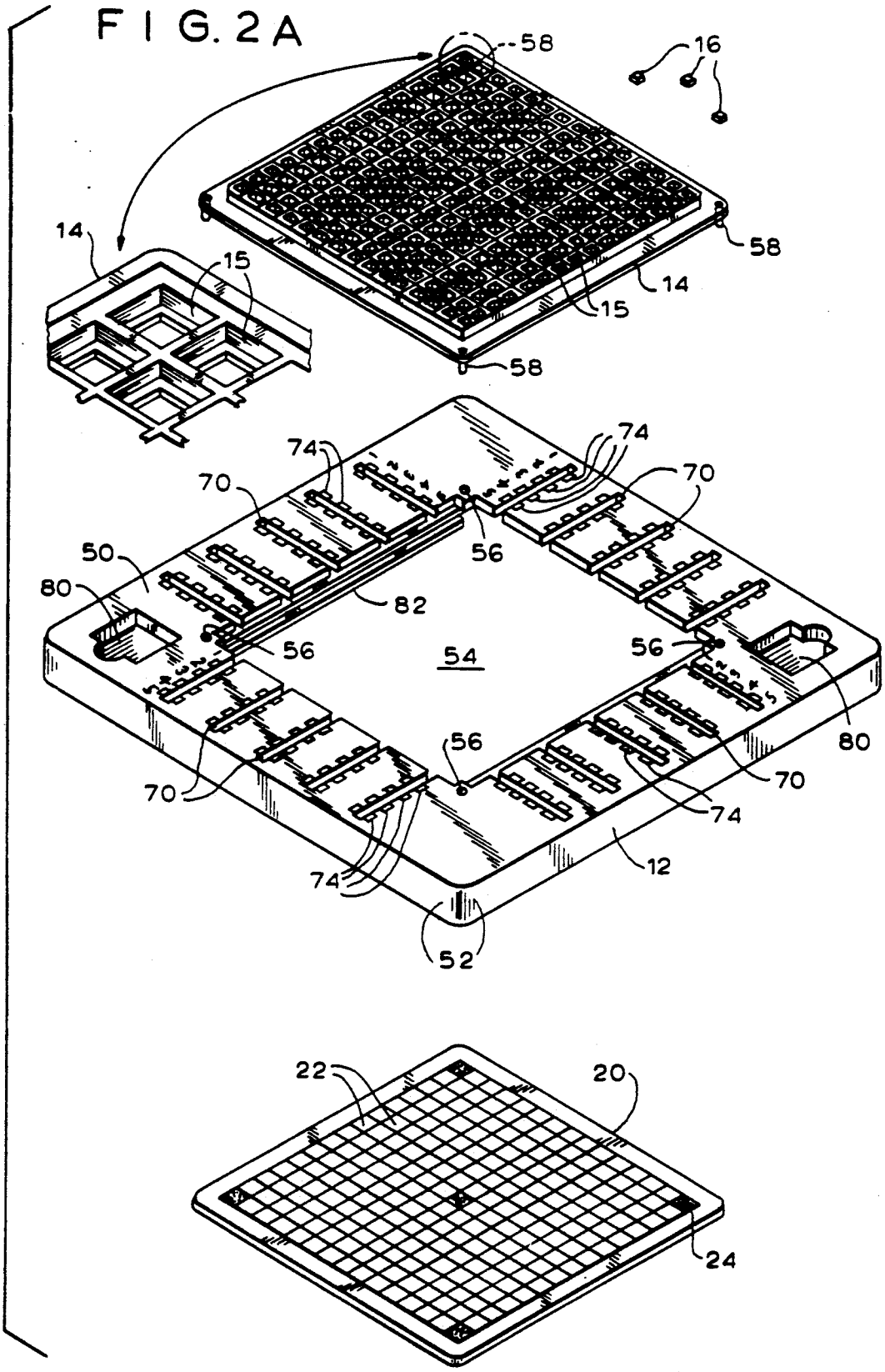
FIGS. 2A and 2B are an exploded isometric view thereof.
Figure 4:
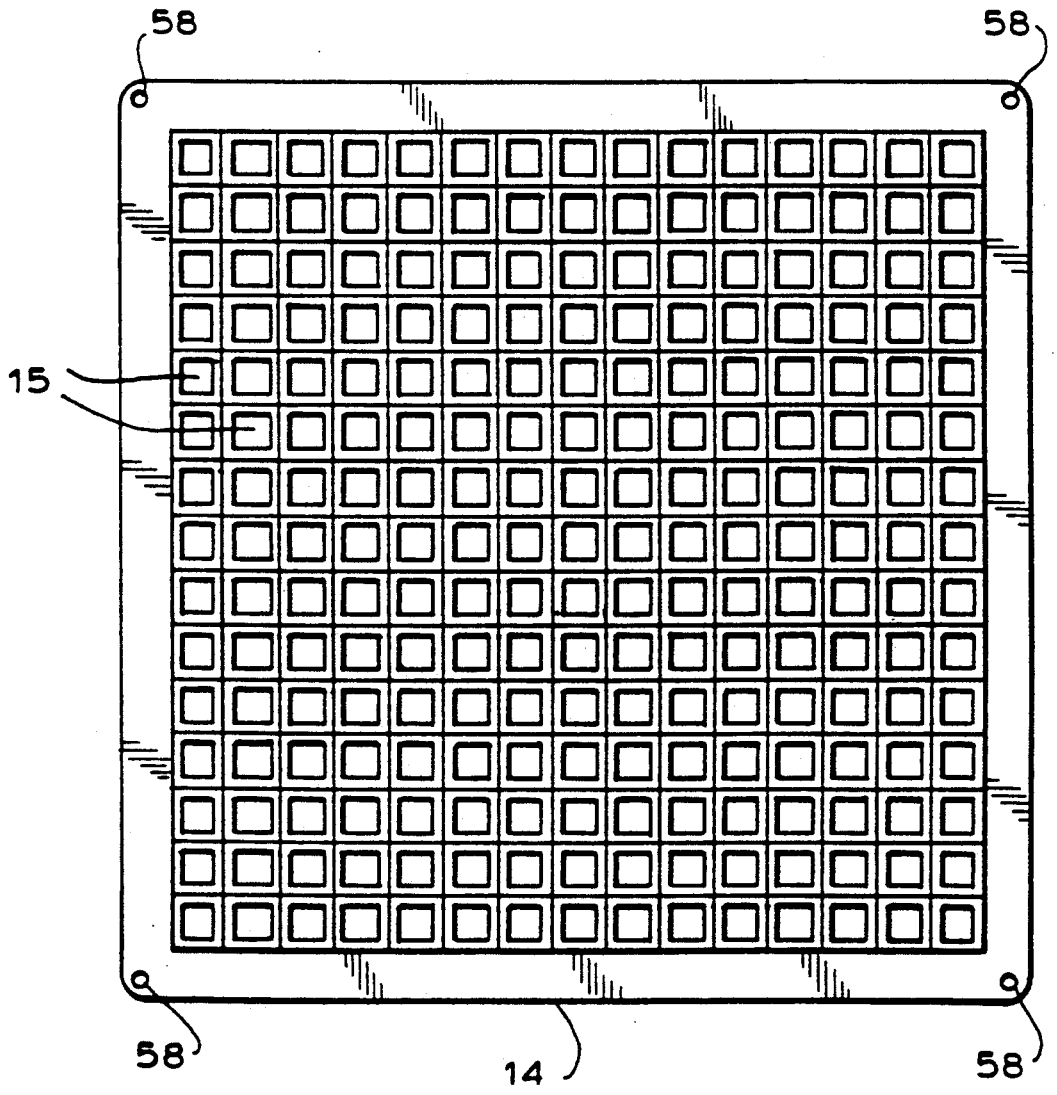
FIG. 4 is a top plan view, to an enlarged scale of the grid.

Referring now to FIGS. 2A and 4 in particular, the grid 14 defines a matrix of squares 15, each square 15 being adapted to receive and support one of the game pieces 16. Depending on the particular nature of the game to be played, the game pieces 16 may bear, for example, a number (as in a Bingo piece), a letter (as in a word game piece), or both a letter and a number (as in a Scrabble piece). The squares 15 defined by the grid 14 are vertically aligned with the squares defined by the conventional game board 20 therebelow, the frame 12 maintaining the desired vertical alignment of the grid 14 and conventional game board 20. The grid 14 prevents the game pieces 16 placed thereon from dropping through the grid 14 onto the conventional game board 20, the grid 14 being configured and dimensioned to effect this function with regard to the particular game pieces 16 being used. The grid 14 may be continuous, with the squares 15 upon which the game pieces 16 rest being transparent (or the entire grid being transparent), or the grid 14 may be apertured (as illustrated) with each square 15 defining an aperture having inwardly extending ledges or shoulders therebelow to support a game piece 16 thereon. Where the grid 14 is continuous, it preferably has a high friction upper surface to restrain horizontal movement of the game pieces 16 thereon. The game pieces 16 are preferably opaque, but may be transparent or translucent (except for the indicia thereon) to facilitate viewing squares therebelow of the slides and conventional game board. The individual game pieces 16 may be square in cross section, as shown, circular, polygonal (e.g., rectangular) or the like, so long as they are appropriately configured and dimensioned for support by the grid 14.

Figure 7:
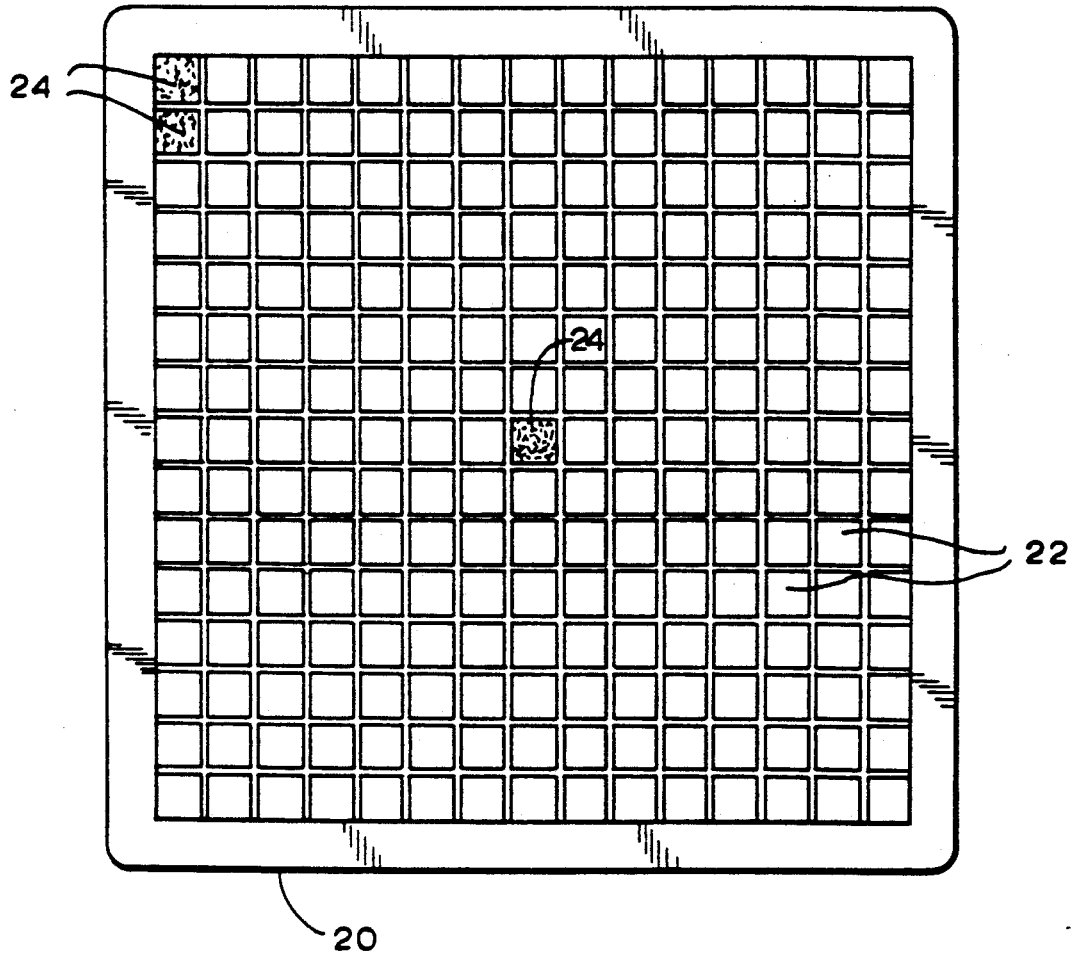
FIG. 7 is a top plan view, to an enlarged scale, of a conventional game board.
Figure 8:
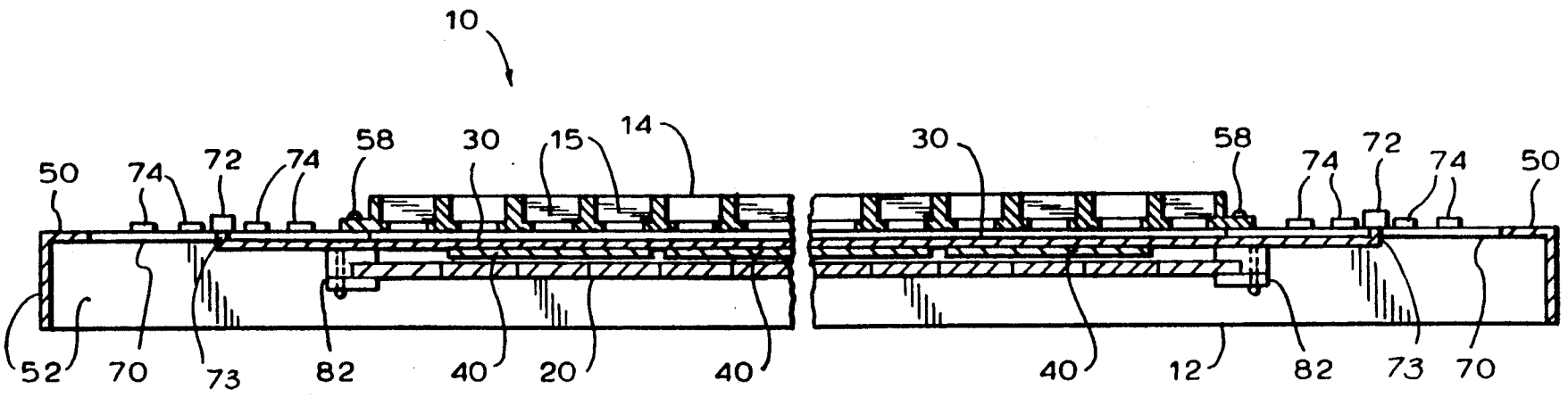
FIG. 8 is a fragmentary sectional view thereof, to an enlarged scale, taken along the line 8—8 of FIG. 1A.

Referring now to FIGS. 2A and 7 in particular, the conventional game board 20 defines a matrix of squares which may be all normal squares 22 or a combination of normal squares 22 and special squares 24 such as bonus squares. Indeed, a variety of different special squares 24 may be defined—for example, double letter squares, triple letter squares, double word squares, triple word squares, quadruple letter squares, etc. The special squares 24 with particular meanings may be characterized by color, alphanumeric printing, or like indicia and so be distinguished from normal squares 22 and other special squares 24 with different meanings.

Figure 2B:
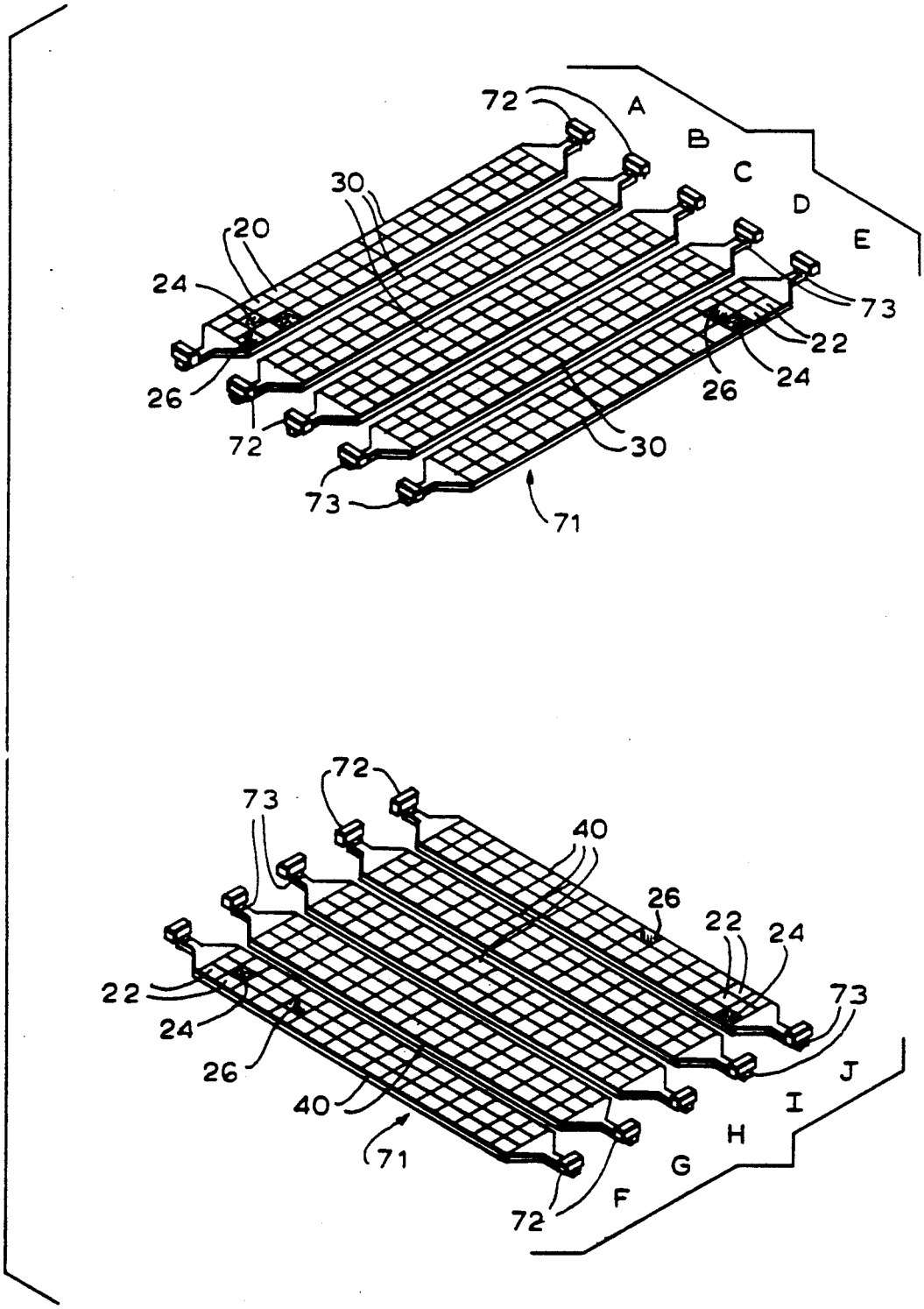
Figure 5:
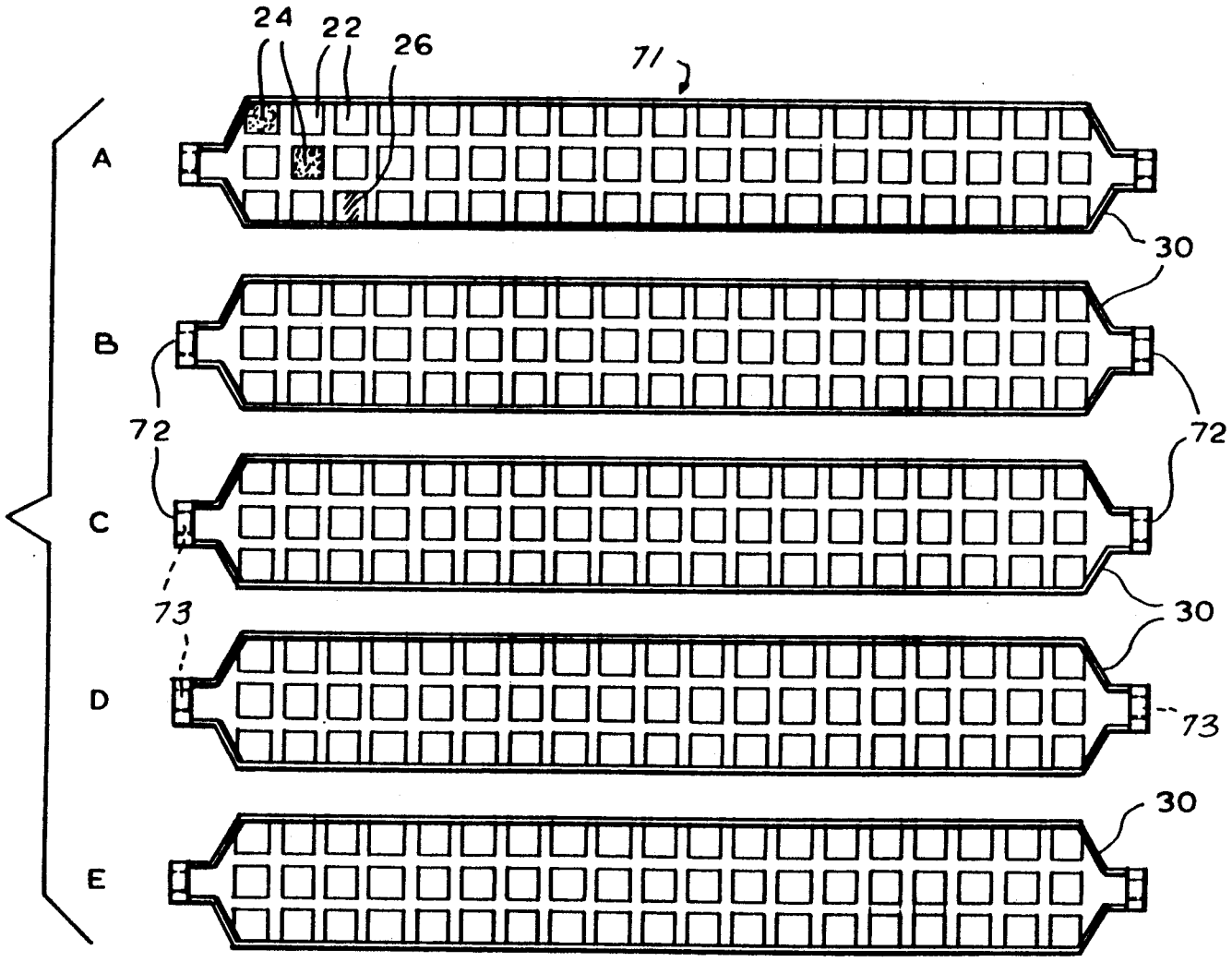
FIGS. 5 and 6 are top plan views, to an enlarged scale, of the first and second sets of slides, respectively.
Figure 6:
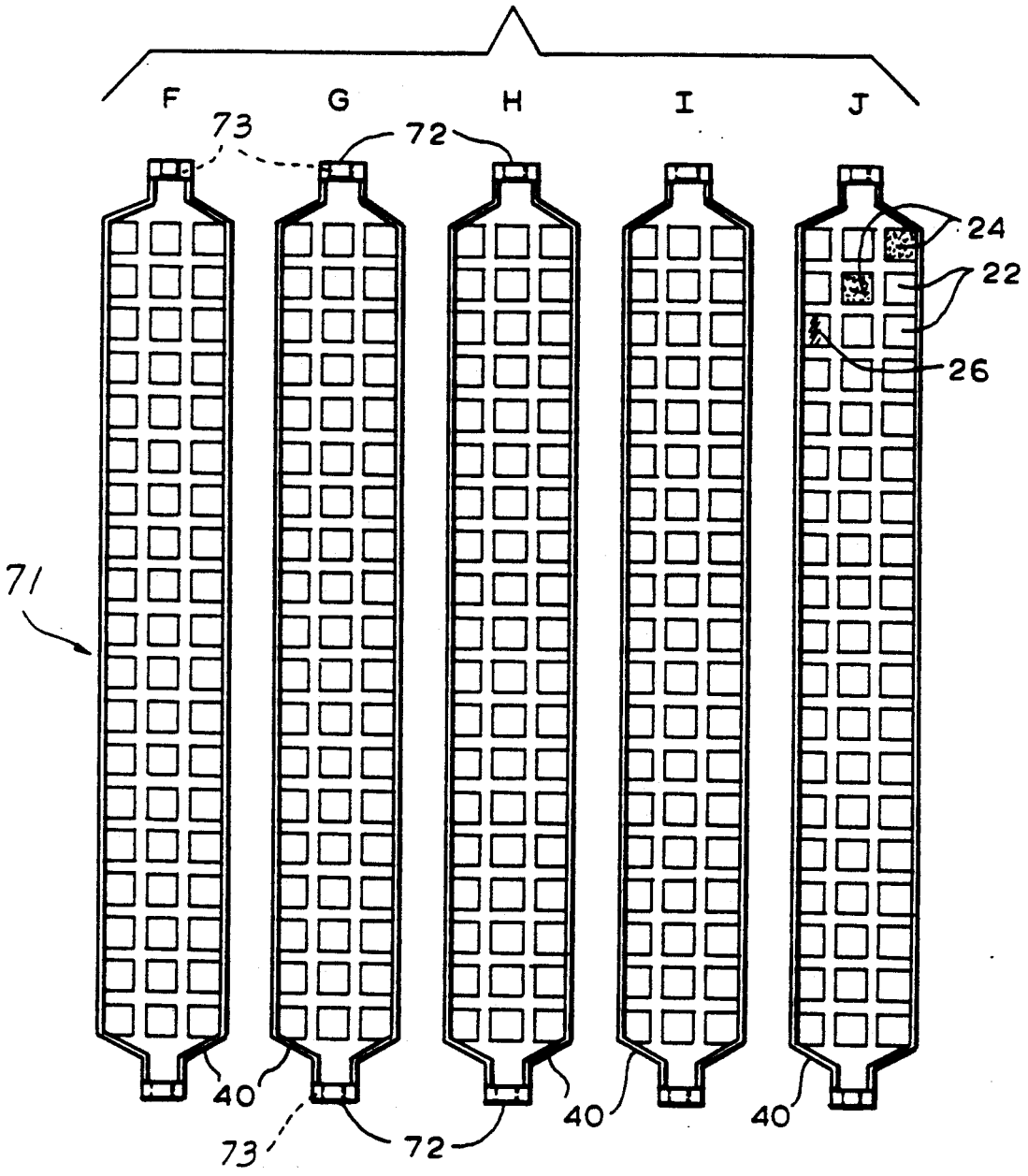

Referring now to FIGS. 2B and 5–6 in particular, a plurality of upper planar slides 30 are disposed in a plane intermediate the grid 14 and the conventional game board 20. Each upper slide 30 defines a plurality of normal squares 22, special squares 24 and see-through squares 26. The see-through squares may be apertured or simply transparent or translucent, so as to permit viewing of a vertically aligned square therebelow. By way of contrast, the normal squares 22 and special squares 24 are opaque, so as to preclude viewing of the vertically aligned squares therebelow. A plurality of lower planar slides 40, oriented transverse to the upper slides 30, is disposed in the frame in a plane intermediate the upper slide 30 and the conventional game board 20. Each lower slide 40 defines normal squares 22 and special squares 24, adapted to be viewed through the see-through squares 26 of the upper slide 30 when the see-through squares 26 are vertically aligned therewith.

Each of the slides 30, 40 is mounted in the frame 12 for independent movement in its respective plane relative to the other of the slides 30, 40 and to the conventional game board 20, so that the operative configuration of normal squares 22 and special squares 24 on the game board may be varied. As illustrated, the upper slides 30 extend longitudinally (i.e., side-to-side) across the matrix of squares 22, 24 defined by the conventional game board 20, and the lower slides 40 extend transversely (i.e., end-to-end) across the same matrix of squares. The totality of the upper slides 30 extends over at least all of the operative matrix of squares, just as the totality of the lower slides 40 also extends at least over all of the operative matrix of squares in all operative positions of the upper slides 30 and lower slides 40. As illustrated, there are a plurality of five upper slides 30 labeled A, B, C, D, E and a plurality of five lower slides 40 labeled F, G, H, I, J, each of the upper slides 30 and each of the lower slides 40 being mounted in the frame 12 for independent movement relative to the remainder of the upper slides 30 and the remainder of the lower slides 40, respectively.

In the preferred embodiment illustrated, at least some of the lower slides 40 additionally include see-through squares 26 enabling viewing of the vertically aligned squares of the conventional game board 20 therebelow through the vertically aligned see-through squares 26 of the upper and lower slides 30, 40. As earlier noted, the conventional game board 20 may define a matrix consisting only of normal squares 22 or a matrix of both normal squares 22 and special squares 24, as illustrated. Where the conventional game board 20 defines a matrix of both normal squares 22 and special squares 24, the lower slides 40 preferably additionally include see-through squares 26 so that there may be a designation of a special square by an upper slide 30, a lower slide 40 (through a see-through square 26 of the upper slide), or the conventional game board 20 (through vertically aligned see-through squares 26 of the upper and lower slides).

Where the conventional game board 20 defines only normal squares 22, so it cannot provide any additional variety to the possible operative configurations of the game board beyond that provided by the slides 30, 40, there is no purpose in having the lower slide include see-through squares 26 as the see-through squares 26 of the lower slides 40 may simply be replaced by normal squares 22. On the other hand, where the lower slides 40 do not include see-through squares 26, preferably the upper and lower slides 30, 40 in a particular orientation together effectively define an operative game board having the conventional configuration of normal squares 22 and special squares 24 that would be found on the conventional game board 20. In this instance—i.e., where the lower slides lack any see-through squares 26—the conventional game board 20 may be dispensed with as it contributes nothing to the game and can be operatively recreated by appropriate positioning of the upper and lower slides 30, 40. For example, when all of the upper slides 30 are moved to one of their extreme or center positions and each of the lower slides 40 are moved to one of their extreme or center positions, the game may present an operative configuration of normal and special squares 22,24 identical to that provided by the absent conventional game board 20—e.g., a conventional Scrabble board—so that the expense of a conventional game board is avoided.

Figure 3:
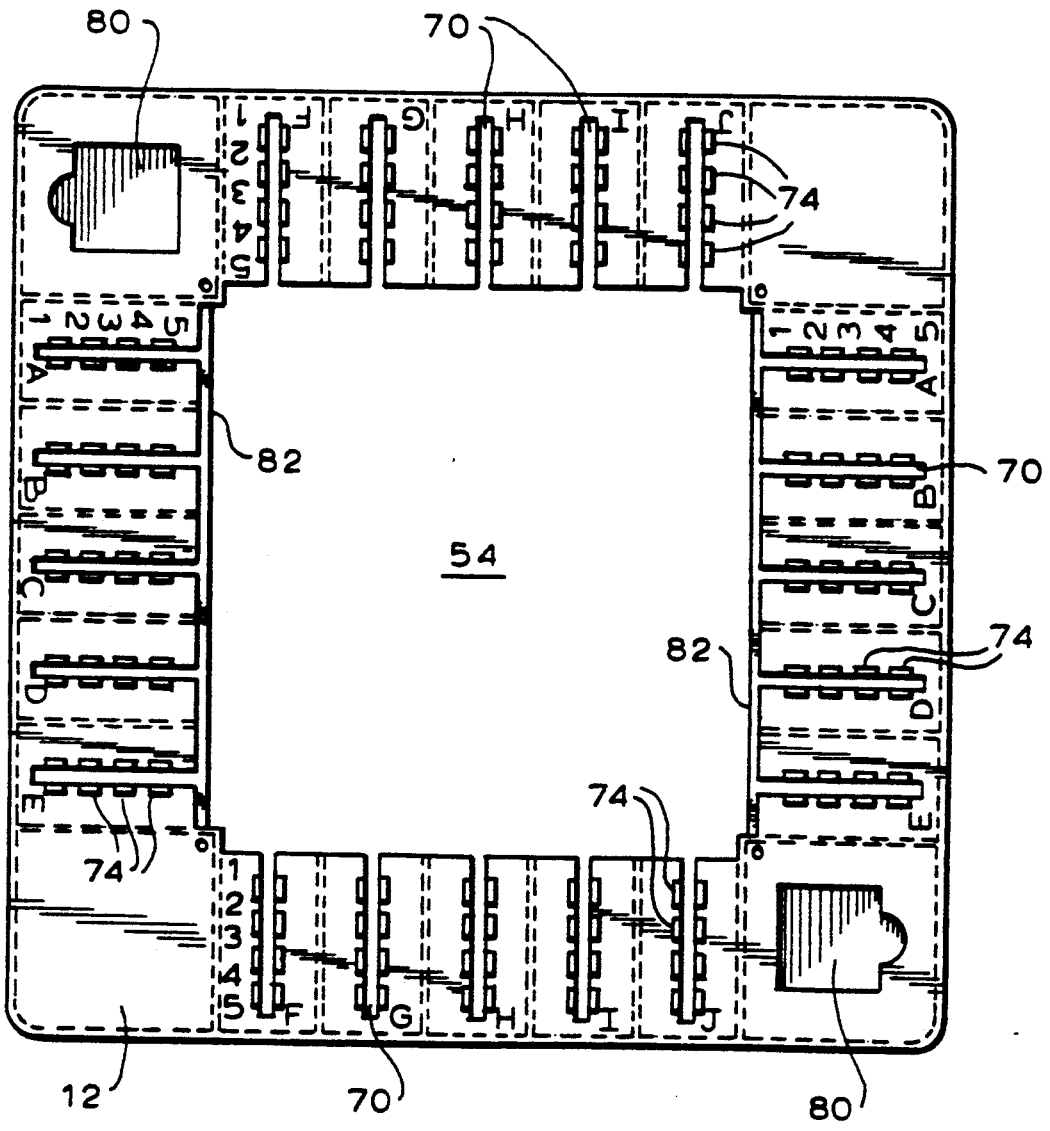
FIG. 3 is a top plan view of the frame.

Referring now to FIGS. 2A, 2B and 3 in particular, the frame 12 defines a generally planar surface 50 having a depending side wall 52 extending peripherally thereabout for spacing the generally planar surface above the support for the game (not shown), such as a table. The planar surface 50 defines a centrally disposed rectangular aperture 54 of the same general size as the grid 14 disposed thereabove and the conventional game board 20 disposed therebelow. Disposed in the frame 12 adjacent each of the corners of the aperture 54 is a small hole 56 extending through the planar surface 50. The grid 14 defines in each of the four corners thereof a downwardly depending peg 58 configured and dimensioned to extend through a respective small hole 56 of frame 12, thereby to lock the grid and frame together as an assembly, movable together as a unit. The frame 12 may be maintained on the pegs 58 by a friction fit or other conventional means may be used to secure (preferably in a releasable manner) the two elements 12, 14 together—for example, a nut (not shown) threaded onto the threaded end of a peg 58. The bottom of the frame 12 defines means to releasably receive and support a conventional game board 20, as will be explained further hereinafter.

The frame 12 additionally defines, on each of the four sides of the square central aperture 54, a plurality of channels 70, the pairs of channels 70 on opposite sides of the aperture 54 being aligned. There is an aligned pair of channels 70 for each slide 30, 40, with five opposed pairs of channels 70 aligned longitudinally across the aperture 54 and five opposed pairs of channels 70 aligned transversely across the aperture 54. Clearly, different numbers of opposed pairs of channels may be used. Each slide 30, 40 has an elongate central portion 71, an upwardly turned T-shaped vertically-extending head 72 at each end, and a neck 73 connecting each head 72 to the central portion 71. As the slide heads 72 and the slide central portions (intermediate the heads 72) are wider than the channels 70, each slide 30, 40 is maintained in a plane parallel to the plane of the planar surface 50 of frame 12. Each slide neck 73 connecting the slide central portion 71 and a slide head 72 thereof enables limited vertical movement of the slide 30, 40 within a channel 70. As one set of slides 30, 40 has its central portions 71 disposed in a plane above the plane in which the central portions 71 of the other set of slides 40 or 30 is disposed, the vertical height of the necks 73 of one set of slides 30 or 40 will be longer than the vertical height of the necks 73 of the other set of slides 40 or 30.

The upper surface of the frame 12 adjacent each channel 70 defines five grooves 74 marked 1, 2, 3, 4 or 5, each groove 74 being adapted to at least partially receive a slide head 72 therein so that gravity maintains the slide head 72 within the groove 74 against accidental horizontal displacement, while permitting the slides 30, 40 to slide easily horizontally along the axis of the aligned channels 70 once both heads 72 thereof have been lifted above the grooves 74. Preferably the grooves 74 are sufficiently shallow that a substantially horizontal manual motion against one slide head 72 is sufficient to overcome the resistance to horizontal motion and enable the one slide 30, 40 to be moved from one position to another.

The conventional game board 20 may be permanently affixed in the frame 12, but is preferably removably secured thereto for replacement and/or reorientation. Thus, the base of frame 12 is provided on each side with rotatably mounted shoulder pins 82 which may be rotated outwardly to enable removal of a conventional game board 20 or inwardly to appropriately position a conventional game board 20. The rotatable shoulder pins 82 are preferably disposed one at each corner, but may alternatively be disposed elsewhere along at least a pair of opposed sides preferably with at least one shoulder pin 82 on each side). Where the configuration of normal and special squares on the conventional game board 20 is not bilaterally symmetrical about both its longitudinal and transverse axes, the conventional square game board 20 is preferably movable between at least two (and preferably among four) orientations relative to the frame 12, both orientations being in the same plane but shifted 90° (or 180° or 270°). Thus in addition to the multitude of different operative configurations of normal and special squares which can be obtained simply by varying the relative positions of the upper and lower slides 30, 40, where the lower slides 40 include see-through squares 26, the conventional square game board 20 may for any given setting of the slides 30, 40 present a plurality of up to three further operative configurations of normal and special squares, depending upon the degree of rotation of the conventional game board 20 relative to the frame 12.

Furthermore, one conventional game board 20 may be replaced by a different conventional game board 20 characteristic of an entirely different type of game, so that the game of the present invention may be at times a word game (such as Scrabble), a number game (such as Bingo), or the like. Thus, simply by interchanging interchangeable conventional game boards 20, the entire character of the game to be played may be varied, this, of course, being in addition to the variety provided by the changes in orientation of the conventional game board 20 for the positioning of the slides 30, 40.

Each slide 30, 40 contains, for any given row or column, a greater number of squares (whether normal, special or see-through) than the corresponding row or column of the grid 14 or conventional game board 20. Thus, as illustrated, each slide contains 19 squares in a given row or column and is movable between positions 1 through 5, which positions are clearly marked on the frame 12. The position 1 . . . 5 of each slide A . . . J defines the operative configuration of normal and special squares for the game board of the present invention. Accordingly, an entire operative configuration for the game can be defined by associating each of the ten slide letters with a respective one of the position numbers. At least one of these configurations (where each of the 10 slides is in a predetermined position) preferably recreates the configuration to be found in the conventional game board.

While there may be a different slide 30, 40 for each row and column of squares, where the conventional game board contains a large number of rows and columns (for example, 15 X 15 for a Scrabble game board), the time required to change the orientation of the game board 20 may be reduced by having a single slide 30, 40 control a plurality of rows or columns. Thus, as illustrated, each of the five upper slides A . . . E controls three rows of squares, and each of the lower slides F . . . J controls three columns of squares. Accordingly, instead of having to move a total of 30 slides (15 upper slides 30 and 15 lower slides 40) it is only necessary to move a total of 10 slides (5 upper slides 30 and 5 lower slides 40). While the use of a single slide to control a plurality of rows or columns reduces the total number of possible different configurations for the operative game board from that which would be possible if each row and each column were independently controlled by a separate slide, the number of possible configurations remains enormous, particularly if different conventional game board orientations are used, as described hereinabove. If desired, for particular applications, each row and column may be controlled by a separate slide or any number of rows or columns (less than the total number of rows and columns) may be controlled by a given slide. In this regard, it should be noted that the orientation of the conventional game board 20 in the frame 12 may also provide for additional configurations of the operative game board.

The game 10 according to the present invention may be sold as a self-contained entity (including its own conventional game board 20 and conventional game pieces 16) or as an upgrade or add-on to conventional games already owned, with the current owner purchasing the frame 12, grid 14, and slides 30, 40 for use with his own conventional game board 20 and game pieces 16. The game according to the present invention is played utilizing the same rules and playing format as the conventional game, but with the added option of play on a continually or periodically changing playing field. Thus the game of the present invention adds an element of chance and random excitement to the conventional game, with the scope of the randomness being completely controlled by the players. This option will add further fun and excitement even to already successful board games.

The slides can be moved after every turn, after one complete round of turns, after a pre-determined number of rounds of turns, whenever the roll of the dice signals a change in game board configuration (this being an agreed upon configuration of the dice such as "doubles"), or only prior to the beginning of each new game, according to the game rules adopted. Thus the frame 12 may be provided with a plurality of indentations or wells 80, each indentation 80 receiving a stack of same-colored cards (not shown)—for example, red cards in one stack and blue cards in another stack. When particular orientations of the dice are thrown or particular squares (such as triple letter squares) are played or periodically after each turn, one of the cards from each of the two stacks is picked up, read and acted upon by the player. The card defines, at least in part, an operative configuration of the game board which may (but does not necessarily) require the slide position to be manually changed in some manner—for example, by moving "move the second horizontal slide all the way to the right," or "move the first and third vertical slides upwardly by one notch," etc.). Indeed, certain cards may call for reorientation of the conventional game board 20 within the frame 12. Alternatively, the cards may define orientations for all of the upper slides 30, or all of the lower slides 40, or for all of the upper and lower slides—for example, slide A to position 3, slide B to position 2, slide C no change, slide D to position 1, slide E to position 4; slide F to position 2, etc.

It will be appreciated that, in the interest of clarity and simplicity, not all of the normal squares 22, special squares 24 (indicated by stippling), and see-through squares 26 (indicated by shading for transparency) have been illustrated in the drawing, but only representative ones thereof.

The entire assembly may be easily and inexpensively fabricated of plastic. The frame 12, grid 14, and conventional game board 20 are preferably substantially rigid, while the slides 30, 40 are, at least in their central portions 71, preferably resiliently flexible so that they may be bent sufficiently to enable the necks 73 to be inserted into the channels 70 of the frame 12 during the assembly process. Once the neck 73 have been slid into the channels 70, the resilient slides resume their full length with each end being maintained at the appropriate level because of the wide head 72 above the neck 73 in relatively narrow channel 70 and the wide central portion 71 therebelow.

Figure 9:
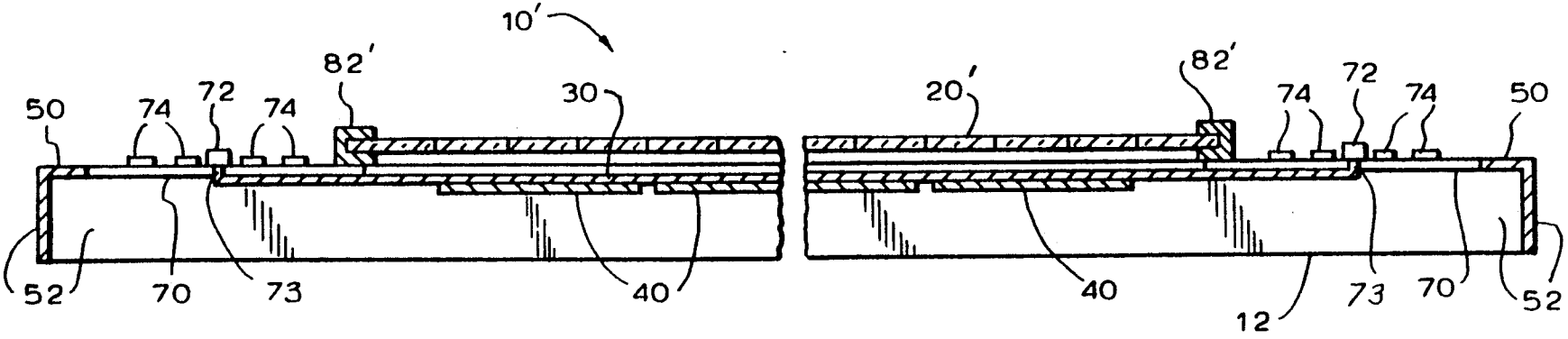
FIG. 9 is a fragmentary sectional view of a second embodiment of the game, similar to FIG. 8.

Referring now to FIG. 9 in particular, therein illustrated is a second embodiment of the game, generally designated by the reference numeral 10'. The second embodiment 10' differs from the first embodiment 10 in that the grid 14 is replaced by a conventional game board 20' (supported by slots 82') which is operatively transparent or translucent so as to enable viewing of the slides 30, 40 therebelow. The upper planar slides 30 are disposed in the frame in a plane between the transparent or translucent conventional game board 20' and the lower planar slides 40 (which are disposed in the frame 12 in a plane below the upper slides 30). The transparent or translucent conventional game board 20' may contain a matrix of only normal squares 22, or a combination of normal squares 22 and special squares 24. As the conventional game board 20' is transparent or translucent, obviously there is no need for see-through squares 26 therein. The lower planar slides 40 are devoid of see-through squares 26. A transparent or translucent conventional game board 20' which comprises only a matrix of normal squares 22 relies totally upon the slides 30, 40 for providing special squares 24. Such a transparent or translucent conventional game board 20' is essentially a grid, similar to grid 14, releasably receiving the game pieces 16 placed thereon and preferably restraining the game pieces 16 against unintended horizontal and vertical displacement. If desired, the transparent or translucent conventional game board 20' may simply define a substantially planar matrix of squares, so that it does not restrain the game pieces 16 against unintended horizontal displacement. While the conventional game board 20' has been described hereinabove as operatively transparent or translucent, it will be appreciated that it may define apertures acting as see-through squares which function as transparent squares.

As present conventional game boards are neither transparent or translucent (nor possessed of apertures acting as see-through squares), typically the second embodiment 10' will be sold as a unit, rather than for use with an existing conventional game board. The first embodiment 10 can be sold as a unit with one or more conventional game boards, or the latter may be purchased separately.

The first and second embodiments 10, 10' of the game in the present invention are used in essentially the same way, except that in the second embodiment 10' the transparent or translucent conventional game board 20' remains in a fixed orientation. To use the first embodiment 10, the game is played according to the normal rules except that there are additional rules specifying the conditions or times under which the operative configuration of the conventional game board 20 will be changed and in what manner—for example, based on time, rolls of the dice, the picking of one or more cards from a well 80, or the like, and resulting in a change of position for one or more of the slides 30, 40 or a change in orientation of the conventional game board 20.

To summarize, the present invention provides a game affording a wide variety of operative configurations of normal squares and special squares, without the need for a supply of separate game boards. The game allows the game board to assume, as one of its operative configurations, the conventional game board configuration of normal and special squares. Further, the game allows different conventional game boards to be used therewith so that a variety of different types of games may be played. The game is of rugged and economical construction.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing disclosure.

I claim:

1. Apparatus for a game played on a game board having an operative configuration of a plurality of squares which is adapted to be changed by the players of the game, comprising:

(A) a frame;

(B) a grid disposed in said frame for releasably receiving game pieces placed thereon and restraining the game pieces against unintended horizontal and vertical displacement;

(C) a plurality of planar slides operatively disposed for sliding movement in said frame in at least two planes below said grid and defining a plurality of squares;

said slides together defining at least a portion of the operative configuration of the game board, each of said slides being mounted in said frame for independent movement relative to the other of said slides and to said grid so that selected portions of the operative configuration of the game board may be independently varied before and during play of the game by movement of at least one of said slides.

2. Apparatus for a game played on a game board having an operative configuration of normal squares and special squares, comprising:

(A) a frame;

(B) a grid disposed in said frame for releasably receiving game pieces placed thereon and restraining the game pieces against unintended horizontal and vertical displacement;

(C) an invariant planar game board disposed in said frame below said grid;

(D) at least one upper planar slide disposed in said frame in a plane intermediate said grid and said planar game board and defining a first set of normal opaque squres, a second set of special opaque squares and a third set of see-through squares; and (E) at least one lower planar slide oriented transverse to said upper slide and disposed in said frame in a plane intermediate said upper slide and said planar game board, said lower slide defining a first set of normal squares and a second set of special squares adapted to be viewed through said see-through squares of said upper slide;

each of said slides being mounted in said frame for independent sliding movement in a given plane relative to the other of said slides and to said planar game board so that selected portions of the operative configuration of the normal squares and the special squares on said game board may be independently varied by movement of at least one of said slides.

3. Apparatus for a game played on a game board having an operative configuration of normal squares and special squares, comprising:

(A) a frame;

(B) an invariant planar, operatively transparent or translucent game board disposed in said frame and having a surface defining a matrix of squares;

(C) at least one upper planar slide disposed in said frame in a plane below said planar game board defining a first set of normal opaque squares, a second set of special opaque squares and a third set of see-through squares;

(D) at least one lower planar slide oriented transverse to said upper slide and disposed in said frame in a plane below said upper slide, said lower slide defining normal squares and special squares adapted to be viewed through said see-through squares of said upper slide;

each of said slides being mounted in said frame for independent movement in a given plane relative to the other of said slides and to said planar game board so that selected portions of the operative configuration of the normal squares and said special squares on said game board may be independently varied by movement of at least one of said slides.

4. The apparatus of claims 2 or 3 additionally including means for independently releasably fixing each of said slides in a given disposition relative to said frame.

5. The apparatus of claims 2 or 3 wherein said planar game board defines a matrix of squares.

6. The apparatus of claim 5 wherein one of said slides extends longitudinally across said matrix of squares, and the other of said slides extends transversely across said matrix of squares.

7. The apparatus of claim 6 wherein the totality of said upper slides extends over all of said matrix of squares.

8. The apparatus of claim 7 wherein the totality of said lower slides also extends over all of said matrix of squares.

9. The apparatus of claims 2 or 3 wherein there are a plurality of said upper slides and a plurality of said lower slides, each of said upper slides and each of said lower slides being mounted in said frame for independent movement relative to the remainder of said upper slides and the remainder of said lower slides, respectively.

10. The apparatus of claims 2 or 3 wherein said special squares are bonus squares affecting the value of game pieces placed thereon or thereon and adjacent thereto.

11. The apparatus of claims 2 or 3 additionally including means for directing a change in slide orientation.

12. The apparatus of claim 11 wherein said directing means comprises one or more decks of cards, each deck including a plurality of cards, at least some of said cards indicating particular slide orientations.

13. The apparatus of claims 2 or 3 wherein said planar game board may be moved between at least two orientations relative to said frame in the same plane but shifted 90°.

14. The apparatus of claim 2 wherein at least some of said lower slides additionally include see-through squares enabling viewing of the vertically aligned squares of said planar game board below vertically aligned see-through squares of said upper and lower slides.

15. The apparatus of claims 2 or 3 wherein said slides in a particular orientation together effectively define an operative game board having the planar game board configuration of normal squares and special squares.

16. The apparatus of claims 2 or 3 wherein said planar game board defines a matrix of only normal squares.

17. The apparatus of claims 2 or 3 wherein said planar game board defines a matrix of both normal squares and special squares.

18. The apparatus of claim 3 additionally including a grid disposed in said frame in a plane above said planar game board for releasably receiving game pieces placed thereon and restraining the game pieces against unintended horizontal and vertical displacement.

19. The apparatus of claim 1 wherein said slides include at least one upper planar slide operatively disposed for movement in said frame in a plane below said grid and having a plurality of squares, and at least one lower planar slide oriented transverse to said upper slide and operatively disposed for movement in said frame in a plane below said upper slide, said lower slide having a plurality of squares.

20. The apparatus of claim 19 wherein said configuration includes a pattern of normal squares and special squares, said upper slide has normal squares, special squares, and see-through squares, and said lower slide has normal squares and special squares adapted to be viewed through said see-through squares of said upper slide.

21. Apparatus for a game played on a game board having an operative configuration of normal squares and bonus squares, comprising:

(A) a frame;

(B) a grid disposed in said frame for releasably receiving game pieces placed thereon and restraining the game pieces against unintended horizontal and vertical displacement;

(C) a conventional invariant planar game board disposed in said frame below said grid, said conventional game board defining a matrix of squares and being movable between at least two orientations relative to said frame in the same plane but shifted 90°;

(D) a plurality of planar upper slides disposed in said frame in a plane intermediate said grid and said conventional game board and defining a first set of normal opaque squares, a second set of bonus opaque squares and a third set of see-through squares, the totality of said upper slides extending over all of said matrix of squares;

(E) a plurality of planar lower slides oriented transverse to said upper slides and disposed in said frame in a plane intermediate said upper slides and said conventional game board, said lower slides defining a first set of normal squares, a second set of bonus squares, and a third set of see-through squares adapted to be viewed through said see-through squares of said upper slides, the totality of said lower slides extending over all of said matrix of squares; each of said slides being mounted in said frame for independent sliding movement in a given plane relative to the other of said slides and to said conventional game board so that selected portions of the operative configuration of the normal squares and the bonus squares on said game board may be independently varied by movement of at least one of said slides; and said slides in a particular orientation together effectively define an operative game board having the conventional game board configuration of normal squares and bonus squares;

(F) means for independently releasably fixing each of said slides in a given disposition relative to said frame.

22. The game of claim 20 additionally including means for directing a change in slide orientation comprising at least one deck of cards, each card indicating a slide orientation.

23. Apparatus for a word game played on a game board having an operative configuration of normal squares and bonus squares which is adapted to be changed by the players of the game, the normal squares indicating a unitary multiplier for the value of letter game pieces placed thereon or thereon and adjacent thereto while the bonus squares indicate a non-unitary multiplier greater for the value of letter game pieces placed thereon or thereon and adjacent thereto, comprising;

(A) a frame;

(B) a grid disposed in said frame for releasably receiving game pieces placed thereon and restraining letter game pieces placed thereon against unintended horizontal and vertical displacement;

(C) a plurality of planar slides operatively disposed for sliding movement in said frame in at least two planes below said grid and defining a plurality of normal squares and special squares;

said slides defining at least portions of the operative configuration of the game board and being mounted in said frame for independent movement to any of a variety of different positions relative to said grid so that selected portions of the operative configuration of the game board may be independently varied by the same or different amounts before and during play of the game by movement of said slides.

* * * * *